US006209391B1

(12) United States Patent
Dallas

(10) Patent No.: US 6,209,391 B1
(45) Date of Patent: Apr. 3, 2001

(54) FREE FALL SURVEY INSTRUMENT

(76) Inventor: Tim Dallas, Science & Technology Park, Campus Three, Balgownie Drive, Bridge of Don, Aberdeen, Scotland (GB), AB22 8GW ( * ) Notice: Subject to any disclaimer, the term of this patent is extended or adjusted under 35 U.S.C. 154(b) by 0 days.

(21) Appl. No.: 09/266,565

(22) Filed: Mar. 11, 1999

(51) Int. Cl.[7] ..... E21B 47/022; G01D 9/042

(52) U.S. Cl. ..... 73/152.46; 73/152.54; 166/254.2; 175/50

(58) Field of Search ..... 73/152.46, 152.54, 73/152.03; 175/45, 237, 50; 166/193, 254.2, 250.16, 250.17

(56) References Cited

U.S. PATENT DOCUMENTS 2,756,511 * 7/1956 Young ..... 33/205.5
4,196,531 * 4/1980 Balligand et al. ..... 37/54
4,485,563 * 12/1984 Sharp et al. ..... 33/314
4,524,324 * 6/1985 Dickinson, III ..... 324/323
4,676,310 * 6/1987 Scherbatskoy et al. ..... 166/65.1
5,804,713 * 9/1998 Kluth ..... 73/152.01

* cited by examiner

*Primary Examiner*—Hezron Williams
*Assistant Examiner*—David J. Wiggins
(74) *Attorney, Agent, or Firm*—Felsman, Bradley, Vaden, Gunter & Dillon, LLP

(57) ABSTRACT

This disclosure describes a blended buoyancy oil well survey instrument capable of performing MWD measurements (measuring while drilling), where the well survey instrument is mounted. An oil well survey instrument in a closed cylindrical housing having a specific gravity greater than the drilling mud in which it is used is modified in buoyancy by attaching one of several identical elongate cylindrical hollow containers or cylinders to it. They are filled with light material. They are made sufficiently strong that they do not collapse at working pressures. The cylinders are provided with upper end and lower end threaded stub shafts and mating receptacles to thread together thereby providing a modified buoyant system. The method is concerned with adjustment of the buoyancy so that the rate of fall is modified; in conjunction with mud flow velocity in the drill string, the buoyant descent of the instrument is controlled to about 100 or 200 feet per minute.

36 Claims, 2 Drawing Sheets

FIG. 3
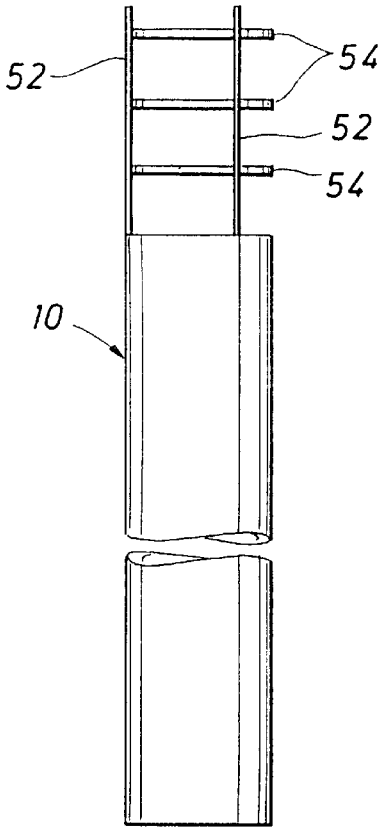
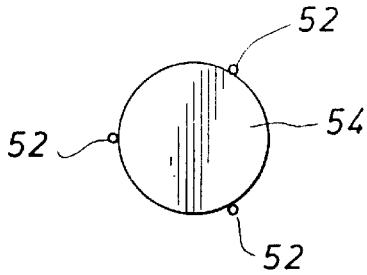
FIG. 4
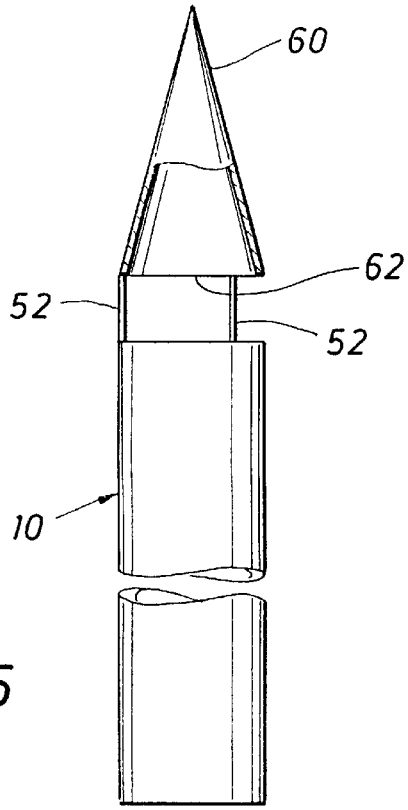
FIG. 5

FREE FALL SURVEY INSTRUMENT

BACKGROUND OF THE DISCLOSURE

In drilling a deep oil well, it is necessary to perform a survey. A survey provides data which is converted into a three-dimensional map of the location of the well. While the well may be vertical at the surface where the well begins, it typically will be deviated from a vertical line. Indeed, with the advent of modern steering tools, it is easy to direct a well in lateral directions. This is more and more common in light of many circumstances. At offshore locations, it is not uncommon to erect a single platform in the water and drill 32 wells from that single platform into a producing formation. All 32 wells are positioned through a common 4×8 template located under the platform. The wells will typically be parallel for a few hundred feet and then will deviate out into several directions. A few of the wells are approximately vertical while another set of the wells will deviate laterally by a few hundred feet, but the greater number of the wells deviate laterally by several thousand feet. They all eventually reach the total depth for the formation, chosen here for purposes of example, at 10,000 feet. It is therefore necessary to make dynamic surveys while drilling to locate the position in space of each well and to direct continued drilling so that each well actually bottoms at the desired point in the producing formation. In land drilling situations, a number of wells have been drilled in what is sometimes called the Austin chalk. The Austin chalk is a very difficult formation in that it is tight producing zone. The Austin chalk is typically located at about 8,000 feet. A vertical well will pass quickly through the Austin chalk and provide only perhaps 10 to 30 feet of production pay zone. It is, however, now technically feasible to deviate the well from the vertical toward the horizontal so that the well is actually drilled along the formation following its shape, contour and slope. This requires that the well be drilled with an incline in the well which matches the incline or dip of the formation. If, for instance, the formation dips by 30° to the north, the well can be deviated so that a portion of it is inclined at the same angle to the north and is located between the top and bottom faces of the formation to increase the pay zone. In the instances given above, it is necessary to repeatedly provide a survey of the location of the well so that periodic corrections can be made. These corrections are needed so that the well location can be adjusted, so that the well will ultimately terminate at the desired location.

A free fall survey instrument is normally dropped in the drill string. This normally occurs when the drill string is in the well borehole. Whether the drill string is actually being turned or not, the drill string captures the MWD capable survey instrument so that it can provide the necessary confinement to retrieve the free fall survey instrument. Moreover, it is periodically essential to retrieve the entire drill string so that the drill bit can be inspected or replaced. When the drill string is retrieved to the surface, it is normally unthreaded, momentarily stored in the derrick stand by stand, and then repositioned in the well to continue drilling after the drill bit has been changed. This enables recovery of the drill string and recovery of the survey tool which is dropped into the drill string. When the survey tool is dropped into the drill string, it begins a free fall trip, recording data as it falls, and storing that data in an electronic memory device in the survey tool. The stored data is later evaluated once the tool is retrieved and the data can be obtained from the memory in the tool. In that context, it is important that the tool be handled carefully so that jarring of the tool does not damage the tool and perhaps obscure or otherwise interfere with the memory function with the risk of data loss. The free fall survey instrument is exposed to severe shock as it bumps and bangs along the drill string as it falls. If, for instance, it falls in a perfectly vertical well, it will accelerate in velocity until it achieves an equilibrium rate of fall. Typically, the equilibrium is determined by the fluid resistance encountered by the free falling body in the drill pipe. The drill pipe is typically filled with drilling fluid. That normally is a water based additive with heavy materials in it. It is commonly known as mud because it typically includes barites and other weight related minerals which raise the weight of the drilling mud and which make it more resistant to the free falling survey instrument. It is not uncommon for a survey instrument to weight about 100 pounds. If merely dropped in space, and falling 10,000 feet, the streamlined survey instrument will accelerate to perhaps 200 mph; fortunately, the fluid in the drill pipe slows the tool down from that high velocity, but not too much. The free fall survey instrument can be protected by mounting a spring on the bottom of it, and that certainly does reduce the impact when landing at the bottom. Nevertheless, there is still some risk of damage to the survey instrument by impact upon landing. It is not possible to drop the instrument on a cable because that then places some kind of cable or tether in the drill string. That poses a problem because the drill string has to be continuously rotated while mud is pumped down through the drill string for drilling. Generally, the open hole is protected best by continuing mud circulation and continuing drilling so interruption is not desirable.

The present disclosure sets forth an improved structure which is appended to the survey tool. This changes the velocity of the survey instrument when it is dropped in the drill string. Briefly, the present disclosure sets forth an attachment which is placed above the survey instrument. It is attached to it. By use of identical threaded joints, each joint having a fixed length, the buoyancy of the survey instrument is changed so that the velocity of the dropped, free falling survey instrument is changed.

When dropping a weight in free fall, the terminal velocity in a long drop is more or less dependent on the viscosity of the fluid. Working with a given streamlined profile (the survey instrument is relatively streamlined), the device will eventually arrive at a steady state velocity for a particular fluid medium resistance to the instrument. If the drill string were simply filled with air, a very high velocity would be achieved. If the drill string is filled with water, a lesser velocity will be achieved. However, drilling with water is normally not done. Rather, the water is a solvent for additives which convert the water into drilling mud and these, in turn, may change the fluid weight and hence the buoyancy relationship of the survey instrument. In one instance, the drilling mud may be quite light, and in another instance, it may be much heavier. Because of these variations which occur depending on the dynamics of the drilling scheduling, it is not possible to know precisely how much buoyancy change is needed even though the weight of the survey instrument does not change. Working with an example, assume that a survey instrument weighs precisely 100 pounds and is precisely 6 feet in length. The terminal velocity in a 10,000 foot well will differ depending on the drilling fluid in the drill string. The present disclosure is therefore summarized as a system for changing the buoyancy of the survey instrument so that the survey instrument is able to be slowed. This reduces the impact while falling where it bangs against the side of the drill string and it also reduces the impact when it lands at the drill bit. Moreover, this can be changed to accommodate changes in the mud schedule from very light to very heavy drilling muds. Further, the trip of the survey instrument is smoother and stretched out over time; this enables the electronics in the survey instrument to obtain a greater number of measurements because it is in the drill string for a longer interval. The equipment comprises one or more threaded joints affixed to the upper end of the survey tool. Each buoyant joint is lighter than the drilling fluid by a controlled amount. The topmost joint is equipped with a fishing neck for retrieval with a grapple.

An alternative embodiment is also set forth. It utilizes the viscosity of the fluid in the well to retard the fall of the instrument. More specifically, the survey instrument is constructed with a fall retarding structure attached at the top end of the instrument. In one embodiment, this has the form of a spaced, trailing, full width disk or inverted cone. So to speak, it catches the fluid during the fall and creates a drag force on it. The drag force asserted on the free-fall instrument package is dependent on the relative diameter of the retarding device, and the stream lining, or more accurately, the lack of stream lining of the retarding member. In one embodiment, the retarding member is simply a parallel disk which is spaced up from the instrument body. In another instance, it is a conic shape. The conic shape can be formed of thin wall metal so that it is rigid or alternately, it can be formed of a resilient material such as a rubber cone.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

FIG. 3 shows a set of disks above the survey instrument to increase fluid turbulence during the drop;

FIG. 4 shows the disk of FIG. 3 and mounting wires for it; and

FIG. 5 shows an alternative drop retarding cone slowing survey tool velocity.

DETAILED DESCRIPTION OF THE PREFERRED EMBODIMENT

Figure 1:
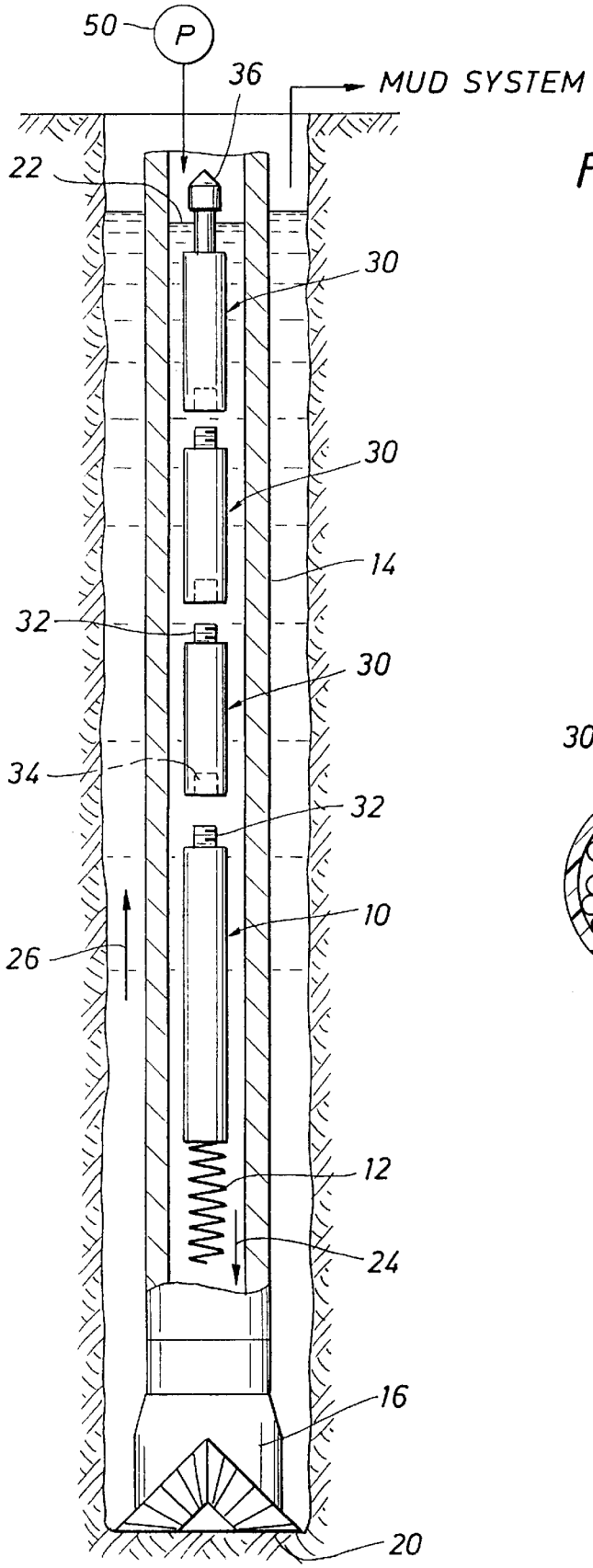
FIG. 1 shows a drill string in a well during drilling further illustrates a survey instrument having controlled buoyancy by incorporation of one or more negative buoyancy sections in accordance with the teachings of the present disclosure.

Going now to FIG. 1, the numeral 10 identifies a free fall oil well survey tool in accordance with the present disclosure. It is normally in a sealed cylindrical housing and weighs about 100 pounds. In this particular instance, it is enhanced with a safety bumper spring 12 affixed to the lower end. This prevents shock impact loading upon bouncing off the bottom of the drill string as will be described. It is normally dropped in a drill string which is comprised of many joints of drill pipe. An example is shown at 14. The several joints of drill pipe are threaded together in a conventional manner. The lowermost joint of pipe is known as a drill collar which is a piece of drill pipe which has an extra thick wall to have added stiffness and weight. It is threaded to a drill bit 16 at the lower end. The drill bit 16 advances the well 20. The well is shown in the only drawing as an open hole uncased well. Eventually, the well is cased by installing a steel pipe in the well and cementing it to the formations penetrated by the pen hole. As shown in the only drawing, the drill string 14 is advance with advance of the drill bit while drilling continues.

Drilling fluid, known as drilling mud, is indicated at 22 and is directed down through the drill string 14. It flows in the direction of the arrow 24. It is returned in the annular space in the manner indicate by the arrow 26. The mud is pumped by the pump 50. The survey instrument 10 of the present invention is typified with an elongate cylindrical body having a diameter of about 1.50 to 1.75 inches and weighing about 100 pounds. Normally, it is about five to ten feet in length. The spring 12 will add another ten or twenty inches in length. When dropped in a free fall fashion, it will bang against the confining drill string 14. This is true with internal upset pipe but it is also true of internal flush pipe joints. Where the well is deviate from the vertical, the survey tool 10 may slide over against one side or the other but it will still experience substantial shock vibration as it falls to the bottom of the well.

The improvement contemplated by the present invention incorporates multiple units of a buoyant chamber 30. One is shown just above the survey instrument 10. The survey instrument 10 is constructed with a short stub shaft 32 which is threaded so that the buoyant chamber 30 can be threaded to it. A matching threaded receptacle 34 is incorporated for that purpose. The two are readily threaded together. If need be, a lock washer is placed between the two to assure that they do not unthread. The buoyant unit 30 incorporates a similar short threaded stub shaft 32 at the top end so that it can thread in like fashion to another buoyant unit 30. As illustrated in the drawings, several such buoyant units are serially connected together in common fashion. In each instance, the buoyant units 30 are preferably made to the same length. They have a common diameter and it is desirable that their diameter be approximately the same as the diameter of the survey tool 10. There is no gain by making them larger in diameter. The topmost buoyant unit is provided with a common stub shaft also to receive by a threaded connection the fishing neck 36. The fishing neck terminates in an industry standard profile to define an upwardly facing point with a shoulder located under the point. This enables a grappling tool to reach over the fishing neck and grab it for retrieval purposes. The fishing neck is included to assure that the elongate cylindrical equipment can be retrieved from a well in the event that a grappling device has to be used. By utilizing a fishing neck conforming with an industry standard, well known grapple devices can be used. An example of this is the overshot made by the Bowen Tool Co.

Figure 2:
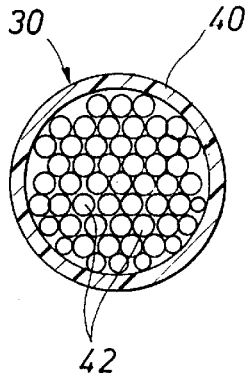
FIG. 2 is a sectional view showing the negative buoyancy section with a set of beads in it.

Going now specifically to the buoyant unit 30, it has a fixed diameter and preferably a common length. It is formed of a plastic tubular member 40 better shown in the sectional view of FIG. 2. It is axially hollow and the cylindrical chamber is packed with a set of beads 42 which are formed of non compressible solid material. The cylindrical container 40 is sized so that it receives a number of the beads in it and is filled with the beads to assure lateral strength and thereby prevent collapsing. Representative pressures will be mentioned below. The buoyant unit 30 has a specified weight and volume which makes the unit 30 buoyant, i.e., it tends to float and would Float if not otherwise weighted with the survey tool 10. In other words, if the buoyant unit 30 were detached and dropped into drilling mud, it would simply float. The wall of the cylindrical chamber 40 is made sufficiently thick that it does not collapse when exposed to ambient pressures as high as about 10,000 psi. As a generalization, a well of 20,000 feet depth will create a bottom hole pressure of about 10,000 psi. This bottom hole pressure is sufficient to crush most closed chambers. To avoid the crushing and to sustain the desired positive buoyancy, the cylinder 40 is made to a specified thickness. A typical material is Lexan which is a registered trademark for a well known structurally reliable material. The beads 42 are packed in the interior. While they define gaps or space which are simply filled with air, they also provide lateral structural stability to the cylinder so that it will not crush even when exposed to the maximum designed pressure. Using a maximum designed pressure of 10,000 psi intended for a well of 20,000 feet in depth, the cylinder 40 has a wall thickness between about 0.25 and 0.50 inches. The buoyant chamber 30 is selected so that the aggregate weight of the chamber 30 (it would otherwise tend to float) therefore modifies the buoyancy of the free fall survey tool 10.

Assume for the moment that the survey tool 10 is dropped into a drill string which is filled with water. The specific gravity of water is assumed in this instance to be 1.00 and further assume that the relative density of the survey tool 10 is 4.00. Assume also that the relative specific gravity of the individual buoyant unit 30 is 0.5. By selecting N units (where N is a whole number integer), the number of buoyant units can be varied to a suitable number so that the density of the free falling survey tool 10 is. changed. As an example, if it is changed by incorporating two or three units, the buoyancy can be brought close to 1.00. Quite obviously, if the net or aggregate buoyancy of the survey tool 10 with several units were less than a 1.00, then the survey instrument would float on the liquid 22. That would prevent it from carrying out its intended function. It is therefore desirable that the number of buoyant units be decreased so that the survey instrument 10 has a specific gravity in excess of 1.00. By adjusting the number of units, the specific gravity can be adjusted. Assume as an example that the target specific gravity is 1.5. This will enable the specific gravity to be adjusted for the composite of the instrument 10 along with N buoyant units 30 thereby yielding a device with controlled buoyancy. In field operations, the weight of the mud in the well will vary with the situation. It may be necessary to add an additional buoyant unit 30 to change the aggregate buoyancy of the assembled survey instrument 10. If that is done, the number can be adjusted up or down to get a different net or average buoyancy. This enables changes in the weight of the mud to be accommodated by changes in buoyancy. For instance, if the weight of the mud is altered markedly, one or two buoyant units 30 can be added as removed.

Each individual unit 30 is identical to the others. Accordingly, a typical tool 10 is shipped to the field for use accompanied with five or six of the buoyant units 30. At that location, the weight of the drilling mud is then determined. Drilling mud weights are normally given in pounds per gallon. While water normally weights about eight pounds per gallon, the drilling fluid can be increased to ten, twelve and even sixteen pounds per gallon. That represents an approximate 100% increase in the specific gravity of the drilling fluid. That therefore will significantly impact the relative buoyancy of the survey tool 10. For that reason, the number of buoyant units may be modified. If the drilling fluid is quite heavy, the number of attached buoyant units 30 can be reduced. Calculations are made on the spot. These calculations become important depending on a couple of other factors. For one, the relative diameter of the tool 10 must provide some clearance between the tool and the drill pipe. A typical survey tool is slightly under 1.5 inches in diameter. When placed in pipe having a nominal four inch size, this defines an adequate clearance between the wall of the pipe and the tool. Clearance must be provided so that the tool 10 can fall in the drill string. The pumping rate depends on a wide range of circumstances. Accordingly, the rate of flow downwardly in the drill string may vary widely. It is not uncommon to operate the mud pump at rates as much as 3,000 gallons per minute. To deliver 3,000 gallons per minute through a typical four inch or five inch drill pipe, the relative linear velocity is quite high. That will therefore carry the survey tool 10 at a very rapid rate. In some cases, it is better to turn the pump off and then drop the tool. Both the pipe diameter and mud flow velocity are information typically that must be known before making adjustments in the buoyancy.

The method of using the present device should be noted. The diameter, length and weight of the survey tool 10 is practically away known and the tool density is therefore always known. Indeed, when manufactured, the weight and density can be marked on the shell. Such markings will assist in the field in making the buoyancy calculations discussed in the present disclosure. The weight of the drilling fluid is then determined. It is rarely maintained as light as water. Once it is determined, this will define the number of buoyant units to be added. It may be necessary to make the combined or blended buoyancy higher or lower dependent on the linear velocity of the pumped mud in the drill pipe.

Generally, if the calculations show that a fraction of one of the buoyant units is required, it is normally desirable to go to the smaller number to thereby increase the relative density of the blended system thereby enabling a more rapid transit in the drill string 14. Again, it should not be made so light that it tends to float.

Perhaps a representative set of data will assist in understanding the present system. Briefly, when the mud system is circulating mud and the pump 50 is being operated in a normal fashion, it can typically deliver about 3,000 gallons per minute which is an extremely high linear rate of flow in the pipe. The pump is operated at a slower rate. A desired rate of fall for the free falling survey tool is as low as about 100 feet per minute, ,but a better rate is about 200 feet per minute. At 200 feet per minute, it takes about 50 minute to cover a 10,000 foot well. The buoyancy is adjusted so that a portion of this velocity is caused by the buoyancy of the free falling survey tool. In other words, it descends at a velocity which is defined by the weight of the drilling mud and the blended buoyancy of the survey tool with the buoyant units 30 attached to it. Without the buoyant units, it would fall more rapidly. Therefore, it is adjusted to fall slower. It can be slowed to a velocity of perhaps 20 to 50 feet per minute in a stagnant column of drilling mud. In fact, however, the column of drilling mud is not held stagnant. Preferably, circulation is continued for the protection of the well. The circulation adds a vector to the velocity of the survey unit. This added vector brings the total velocity to about 100 or 200 feet per minute. At 200 feet per minute, sufficient data is normally obtained for adequate resolution of the pathway of the well borehole.

ALTERNATIVE EMBODIMENTS

An alternative embodiment is illustrated in FIG. 3 of the drawings. In that view, the survey tool 10 is again illustrated. The survey tool 10 is constructed in the same fashion as before, has the same weight and dimensions, and is otherwise subjected to the same risk as before. It is handled in the same fashion in all aspects. At the to end, the survey tool 10 is provided with three or four relatively fine flexible wires 52. These extend upwardly and are approximately parallel to the center line axis of the survey instrument housing. The length is sufficient to support two or three transverse disks. Each disk 54 has a diameter that is approximately equal to the diameter of the tool. At least one disk is installed; preferably, two or three will do the job better. They serve as a spoiler which follows the flow of descent. They cause turbulence as the drilling fluid flows around the several disk. As shown in FIG. 4 of the drawings, each disk 54 is a solid body. It simply reduces stream lining and increases turbulence, thereby slowing the rate of fall. When he survey instrument 10 increases in speed, the turbulence increases in a nonlinear fashion so that the greater level of turbulence slows the instrument even more so. The spacing of the several disk is not specifically mandated at any particular location. Rather, the disk are set sufficiently apart that they intercept the flow and cause turbulence.

An alternative embodiment is shown in FIG. 5 of the drawings. Again, this view shows the instrument 10 and it is again equipped with one or several of the support wires 52. As before, three or four are normally adequate. It carries or supports an inverted cone 60. The cone 60 (formed of metal or resilient sheet material) is an inverted cone so that it has an open mouth. The mouth 62 intercepts the flow, and catches the fluid flow during relative movement downwardly, thereby retarding the rate of fall. It is deployed behind or trailing the instrument 10. This falling body is slowed dependent on the drag by the cone 60. The cone is spaced from the body 10 by a distance sufficient to catch the fluid flow. If desired, the cone can be provided with a small opening at the apex. The retardant action of the cone during free fall generally increases with velocity. As before, the effectiveness of the cone is dependent on a number of scale factors. For instance, the relative diameter of the mouth of the cone in relationship to the diameter of the survey tool 10 is one factor, and the relative diameter of the cone with respect to the drill pipe is anther factor.

As shown in FIG. 5, the support wires 52 are relatively short. Optionally, they can be extended so that they are longer than the cone and surround the cone, thereby functioning as a confinement cage. Also, they can be made longer so they function somewhat in the fashion of a centralizer which keeps the free falling instrument 10 approximately centered in the drill string.

The embodiments set forth in FIGS. 3, 4, and 5 do not change the buoyancy of the tool. Rather, they retard the rate of falling. The buoyancy, however, can be changed if desired so that the instrument package 10 is attached to one or more of the buoyant bodies 30 and that is then connected to the disk 54 shown in FIG. 3 or the cone 60 shown in FIG. 5.

While the foregoing is directed to the preferred embodiment, the scope can be determined from the claims which follow.

What is claimed is:

1. A method of making an MWD free fall survey of a subterranean borehole or earth formation with an untethered oil well survey instrument in a drill string comprising the steps of attaching to the instrument a buoyant member so that the buoyancy of the attached survey instrument and buoyant member is greater than the buoyancy of the survey instrument and then dropping the instrument in the drill string.

2. The method of claim 1 wherein the blended buoyancy is increased to thereby control a rate of descent of the oil well survey instrument to a rate dependent on blended buoyancy compared with the weight of drilling mud in the drill string, and further including the step of pumping drilling mud into the drill string at a controlled downward velocity.

3. The method of claim 1 including the step of attaching multiple buoyant members to the instrument to thereby increase the buoyancy while maintaining the buoyancy so that the instrument sinks in the drilling mud, wherein the first buoyant member is attached to the instrument and additional buoyant members are attached in a vertically stacked arrangement to the first buoyant member.

4. The method of claim 1 wherein said buoyant member is an elongate cylindrical member having upper and lower connectors thereon, and comprising the steps of connecting the buoyant member to the instrument with a connector thereon.

5. The method of claim 4 wherein said instrument is constructed with an upper end and the upper end supports a connector thereon and making connection of said buoyant member thereto.

6. The method of claim 1 including the step of adjusting the blended buoyancy so that the instrument falls in a column of drilling mud in the drill string, and controllably operating a pump with a mud system for the drill string wherein mud is directed downwardly through the drill string, and the oil well survey instrument traverses downward through the drill string at a controlled velocity.

7. The method of claim 6 wherein the velocity is not greater than about 200 feet per minute.

8. The method of claim 7 wherein the velocity is partly attributable to the untethered fall of the oil well survey instrument in the drill string, and is partly attributable to the flow of mud in the drill string.

9. The method of claim 1 wherein the untethered oil well survey instrument is dropped into the drill string and descends in a column of drilling mud in the drill string until it arrives at the lower end of the drill string, and conducting an oil well survey as the oil well survey instrument traverses the drill string, and further including the step of retrieving the drill string to thereby retrieve the oil well survey instrument.

10. The method of claim 1 including the step of pumping drilling fluid into the well during drilling which is delivered through the drill string, and controlling the weight of the mud in the mud system to relatively change the blended buoyancy by changing the mud system.

11. The method of claim 1 including the step of pumping mud into the drill string wherein mud flow is returned to the surface through an annular space on the exterior of the drill string, and controlling the downward flow velocity of the mud in the drill string, and adjusting the blended buoyancy of the survey instrument so that the cumulative velocity of the instrument in the drill string does not exceed a specified maximum.

12. The method of claim 11 wherein the maximum is about 200 feet per minute, and wherein the velocity of the instrument is partly attributable to the rate of fall thereof in the drill string, and is partly attributable to the flow velocity of mud in the drill string.

13. The method of claim 12 including the step of conducting an oil well directional survey as the oil well survey instrument traverses the drill string, and further including the step of retrieving the drill string to the surface to thereby retrieve the oil well survey instrument with survey data therein.

14. The method of claim 13 including the step of landing the survey instrument above the drill bit at the bottom of drill string, and retrieving the drill string to the drill bit so that the survey instrument is retrieved.

15. The method of claim 12 including the step of landing the survey instrument at the drill bit on a resilient shock absorbing member.

16. The method of claim 1 including the step of attaching a resilient bumper under the untethered oil well survey instrument so that the instrument when dropped in the drill string lands thereon, and further including the step of attaching the buoyant member to said survey instrument at a releasable threaded connection, and dividing said buoyant member into multiple individual buoyant members to enable connection of the individual multiple buoyant members thereto.

17. An MWD free fall apparatus for controlling a rate of descent of an oil well survey instrument in a drill string through a subterranean borehole or earth formation wherein the apparatus comprises an elongate oil well survey instrument in a closed housing having an upper end connector thereon, and further including an elongate buoyant member attached to said oil well survey instrument at said connector and wherein the buoyancy of the attached buoyant member and survey instrument is greater than the buoyancy of the oil well survey instrument.

18. The apparatus of claim 17 wherein said buoyant member comprises an elongate hollow cylindrical member having upper end and lower end connectors thereon to thereby enable multiple units of said buoyant member to be attached in a vertically stacked arrangement to the first buoyant member using upper end and lower end connectors.

19. The apparatus of claim 18 wherein said upper end and lower end connectors comprise cylindrical threaded stub shafts and mating threaded receptacles engaging said shafts.

20. The apparatus of claim 17 wherein the uppermost buoyant member supports a fishing neck.

21. A method of making an MWD free fall survey of a subterranean borehole or earth formation with an untethered oil well survey instrument in a drill string comprising the steps of attaching to the instrument a fall retarding member so that the velocity in a fall thru a drilling fluid is reduced due to increased friction against said drilling fluid and then dropping the instrument in the drill string.

22. The method of claim 21 wherein the velocity of a fall is decreased to thereby control the rate of descent of the oil well survey instrument dependent on the weight of drilling mud in the drill string, and further including the step of pumping drilling mud into the drill string at a controlled downward velocity.

23. The method of claim 21 including the step of attaching multiple fall retarding members to the instrument to thereby increase the fall retardation so that the instrument sinks more slowly in the drilling mud.

24. The method of claim 21 wherein said fall retarding member is a cylindrical member on, and comprising the steps of connecting the member above the instrument.

25. The method of claim 24 wherein said instrument is constructed with an upper end and the upper end supports at least one connector to said fall retarding member.

26. The method of claim 21 including the step of adjusting the velocity so that the instrument falls in a column of drilling mud in the drill string, and controllably operating a pump with a mud system for the drill string wherein mud is directed downwardly through the drill string, and the oil well survey instrument traverses downward thru the drill string at a retarded velocity.

27. The method of claim 26 wherein the velocity is not greater than about 200 feet per minute.

28. The method of claim 27 wherein the velocity is partly attributable to the untethered fall of the oil well survey instrument in the drill string, and is partly attributable to the flow of mud in the drill string.

29. The method of claim 21 wherein the untethered oil well survey instrument is dropped into the drill string and descends in a column of drilling mud in the drill string until it arrives at the lower end of the drill string, and conducting an oil well survey as the oil well survey instrument traverses downward through the drill string, and further including the step of retrieving the drill string to thereby retrieve the oil well survey instrument.

30. The method of claim 21 including the step of attaching a resilient bumper under the untethered oil well survey instrument so that the instrument when dropped in the drill string lands thereon, and further including the step of attaching the buoyant member to said survey instrument at a releasable threaded connection, and dividing said buoyant member into multiple individual buoyant members to enable connection of the releasable threaded connector to a vertically stacked arrangement of the individual multiple buoyant members thereto.

31. The method of claim 21 including the step of pumping drilling fluid into the well during drilling which is delivered through the drill string, and controlling the velocity of the mud in the mud system.

32. The method of claim 21 including the step of pumping mud into the drill string wherein mud flow is returned to the surface through an annular space on the exterior of the drill string, and controlling the downward flow velocity of the mud in the drill string, and adjusting the velocity of the survey instrument so that the cumulative velocity of the instrument in the drill string does not exceed a specified maximum.

33. The method of claim 32 wherein the maximum is about 200 feet per minute, and wherein the velocity of the instrument is partly attributable to the rate of fall thereof in the drill string, and is partly attributable to the flow velocity of mud in the drill string.

34. The method of claim 33 including the step of conducting an oil well directional survey as the oil well survey instrument traverses the drill string, and further including the step of retrieving the drill string to the surface to thereby retrieve the oil well survey instrument with survey data therein.

35. The method of claim 34 including the step of landing the survey instrument above the drill bit at the bottom of drill string, and retrieving the drill string to the drill bit so that the survey instrument is retrieved.

36. The method of claim 35 including the step of landing the survey instrument at the drill bit on a resilient shock absorbing member.

* * * * *